United States Patent [19]

Corso

[11] 4,185,277

[45] Jan. 22, 1980

[54] TRIP ALARM CIRCUIT

[76] Inventor: Philip P. Corso, 6607 S. Grande Dr., Boca Raton, Fla. 33433

[21] Appl. No.: 878,312

[22] Filed: Feb. 16, 1978

[51] Int. Cl.[2] ..... G08B 19/00

[52] U.S. Cl. ..... 340/508; 340/523

[58] Field of Search ..... 340/501, 500, 507, 508, 340/522, 523

[56] References Cited

U.S. PATENT DOCUMENTS

| | | | |
|---|---|---|---|
| 3,665,399 | 5/1972 | Zehr et al. | 340/501 |
| 3,917,001 | 11/1975 | Davis et al. | 340/508 |

*Primary Examiner*—Alvin H. Waring

*Attorney, Agent, or Firm*—Howard I. Podell

[57] ABSTRACT

A trip circuit and an off-normal anticipatory circuit that are each triggered by independent switch contacts and must be in accord in order to allow shutdown to occur, are each provided with an additional set of sensor switch contacts connected in series with the first respective contacts for increased reliability.

2 Claims, 4 Drawing Figures

TRIP ALARM CIRCUIT

BACKGROUND OF THE INVENTION

In recent years all industry has become aware of the failure potential of unit or plant protection (trip) systems. Two important concepts are involved: reliability and security.

The reliability of any system is defined as the ability to deliver a trip signal when required. The security of any system depends upon the ability to prevent spurious or false trips under many adverse conditions.

Although no system can be made immune from equipment failures, a greater degree of reliability can be achieved with redundancy. This can be defined as the introduction of auxiliary elements and components to perform the same function as other elements in the system.

It is well known that the reliability of an unredundant system is a decreasing function of the failure rates of components, of the system size and of the time the system functions. Protection systems are always tending to increase in size and complexity. To maintain system reliabilities at acceptable levels, these increases must be counteracted either by a reduction in failure rates, or by applying redundancy. Impressively large improvements can be achieved by using a fairly small degree of redundancy. This must be compared to the relatively small improvements in unredundant system reliability which can only be produced by large expenditures of time and money in component improvement, testing and inspection.

Redundancy schemes are various and obviously each has its own value, which relates to its extra cost and the increased degree of protection. In this respect, the invention disclosed here offers value which is higher than those offered by conventional and known redundancy schemes.

SUMMARY OF THE INVENTION

The objective of the invention being to increase the reliability of trip circuits, which are activated by sensor switches with their contacts, the novelty feature of the invention resides in adding and utilizing additional and redundant sensors activating their additional and redundant contacts in both the off-normal anticipatory and trip circuits. The main advantage of the invention is that it is able to substantially increase the reliability of the system with the use of only slight additional redundancy that neither substantially increases the cost of protective system, nor substantially reduces its security, i.e. ability to guard against false trips and nuisance shutdowns.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
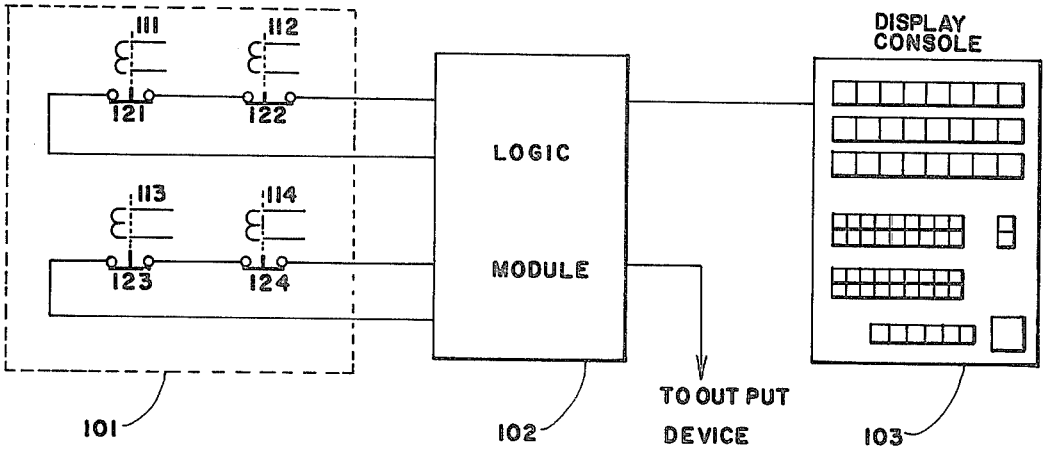
FIG. 1 is a block diagram of a typical signal channel of the system utilizing the invention.

Turning now descriptively to the drawings, in which similar reference character denote similar elements throughout the several views, FIG. 1, which in a way of introduction shows the application of the invention in a shutdown system. A single signal channel, usually one of many employed to monitor a process or an apparatus (not shown), whose presence is indicated by block 101. Sensors 111, 112, 113 and 114 each measure an individual variable to be monitored, and each respond to changes by opening associated contacts 121, 122, 123 or 124 respectively that are normally closed. Electrical current passes through wires running from location 101 to logic module 102 to direct the logic module 102 to react to the contact and, at a proper instance, produce a command signal to an output device (not shown) to effectuate a shutdown, and to operator display console 103, to inform the operator of the condition of the circuit monitored.

Figure 2:
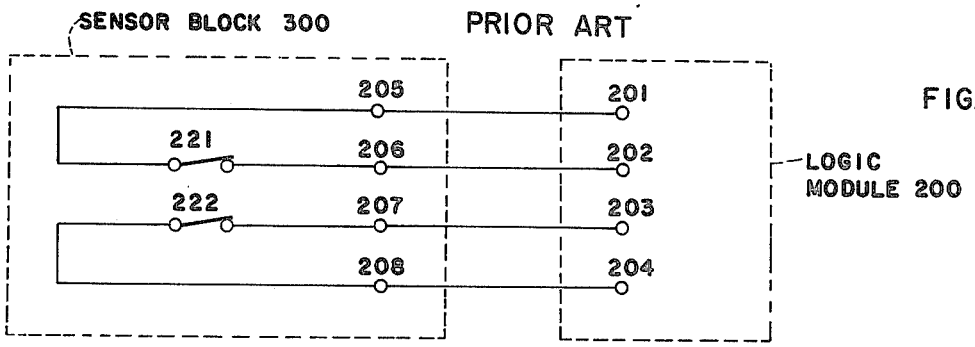
PRIOR ART FIG. 2
FIG. 2 is an electrical wiring diagram representing a conventional circuit arrangement known as "unanimous voting"

FIG. 2, representing known art, is placed here for illustrative purposes, to conveniently compare and specifically point out the improvement which differentiates and characterizes the invention.

Figure 3:
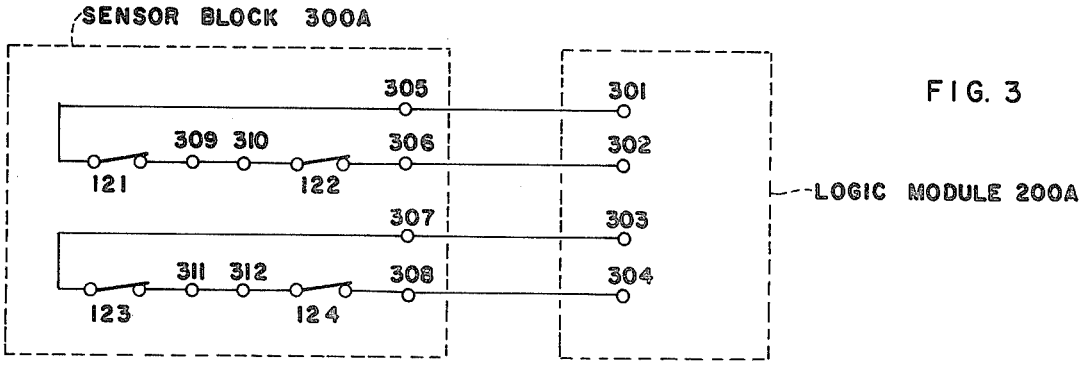
FIG. 3 is wiring diagram representing the invention.

The invention improves upon a known redundancy scheme which is called in the art "unanimous voting", and is shown in FIG. 3. In this scheme, a sensor activates an off-normal anticipatory circuit, when a condition of a variable being monitored approaches that which will require trip action. If the variable continues to deteriorate, the trip sensor will be activated and together these two actions will allow for a trip to occur. It will not be called for, however, if either of the sensors, off-normal or trip, did not activate.

As seen in FIG. 2, terminals 201–204 are those of a logic module 200, terminals 205–208 are output terminals of sensor block 300 in which a pair of contacts 221 of an off-normal sensor and a pair of contacts 222 of a trip sensor are located. Both contact pairs 221 and 222 are normally closed, allowing a signal current to pass through each contact pair.

Logic module 200 is designed to produce a command signal to effectuate a shutdown only if contacts 221 and 222 are both opened by their respective sensors.

The invention improves on the performance of the circuit of FIG. 2 by adding, in each of the above circuits, another sensor with a pair of normally closed contacts in series with each pair of normally closed original contacts, as shown on FIG. 3. Here, in a normal and expected way of its action, the off-normal circuit will become operative with simultaneous action of either or both sensors opening their contact pairs 121, 122 respectively. Should one of these sensors fail, or be otherwise impaired from performing its function as intended, the second and redundant sensor contact will perform its expected action of opening the off-normal circuit. Similar performance will be characteristic of the trip circuit, with normally closed sensor contact pairs 123, 124 connected in series and backing each other up in their redundancy. The number of wires and external terminals needed to interconnect the sensor block 300A with the logic module 200A does not increase in comparison with the "unanimous voting" circuit of FIG. 2 and the number of terminals on the sensor block 300A increases only by four, namely, terminals 309–312.

Studying the behavior of the redundancy scheme shown on FIG. 3, it becomes apparent that it will not likely fail to respond whenever the response is called for, the probability of failure of two analogous devices each independently controlling a contact 121, 122 respectively, being extremely low. Moreover, the spurious action of the scheme, namely an unnecessary actuation of a shutdown, remains of the same order of magnitude as in the scheme of FIG. 2, since both circuits employ the same logic to eliminate false actuation. Thus, slight additional redundancy brings advantages unmatched by any other redundancy scheme in similar circumstances.

Figure 4:
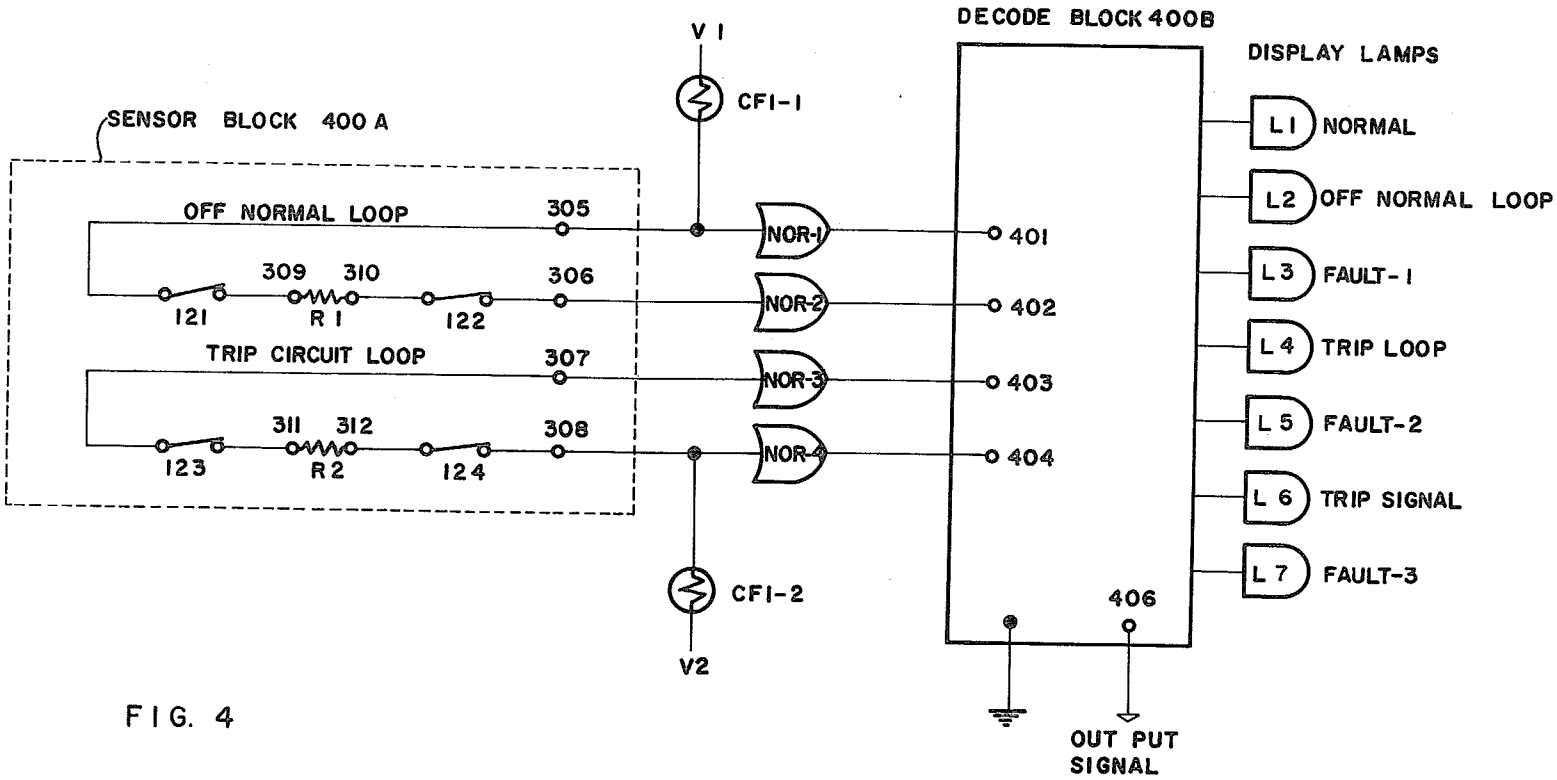
FIG. 4 is a schematic drawing of an alternative embodiment of a Fault Detection Circuit employed with the invention.

FIG. 4 illustrates an alternative embodiment of the device for controlling an output signal to an output device (not shown) for effectuating a shutdown and for display of lamps L1–L7 to indicate the status of the control circuitry of sensor block 400A.

Sensor block 400A is similar to design and function of sensor block 300A, but with a resistor R1 joining terminals 309 and 310 and a resistor R2 joining terminals 311 and 312.

Decoder block 400B is a solid state logic module internally connected to input terminals 401–404, display lamps L1–L7 and an output signal terminal 406 so as to connect one or more display lamps L1–L7 and output signals terminal 406 to a source of voltage (not shown) under the conditions indicated by the Truth Table listed hereinafter depending on the combination of voltage signals fed to each input terminal 401–404.

Off-normal circuit of sensor contact pairs 121, 122 are supplied by a first voltage V1 through a first Circuit Fault Interrupter CFI-1, with Trip Circuit contact sensor contact pairs 123, 124 supplied by a second voltage V2 through a second Circuit Fault Interrupter CFI-2. Both Circuit Fault Interrupters are solid state devices that act as self-resetting fuses to interrupt the attached circuit upon passage of an excessive current.

Each circuit loop end 305–308 terminates in the input of a respective NOR gate NOR-1–NOR-4 respectively. Each NOR gate switches the respective terminal 401–404 to a high voltage level when there is no voltage applied to its input and switches the respective terminal 401–404 to a low voltage level when a voltage is applied to its input.

CFI-1 and CFI-2 are each set to open at a current above the normal current in the attached circuit based on the value of R1, R2 and the resistance of the NOR gates, when contacts 121–124 are closed. If a ground fault occurs in either circuit loop, or if a resistance R1 or R2 becomes "shorted", the respective Current Fault Interrupter will open turning both NOR gates of that circuit loop to the high voltage output condition.

If either or both of off-normal contacts 121, 122 open, NOR-2 will switch to the high voltage output state, and if either or both of trip circuit contacts 123, 124 open, NOR-3 will switch to the high voltage output state.

Decoder Block 400B is internally wired so that output signal terminal 406 is energized only if both terminals 402 and 403 are at the high voltage state.

In the following Truth Table, representing all the various sixteen combinations of states of the four NOR gates, "0" represents a low voltage output state (high voltage input) of the respective NOR gate and "1" represents the reverse condition.

TRUTH TABLE

| COMBINATION | NOR-4 | NOR-3 | NOR-2 | NOR-1 | CONDITION | LAMP DISPLAYED |
|---|---|---|---|---|---|---|
| A | 0 | 0 | 0 | 0 | Normal | L1 |
| B | 0 | 0 | 0 | 1 | Fault 1 | L3 |
| C | 0 | 0 | 1 | 0 | Off-Normal Loop | L2 |
| D | 0 | 0 | 1 | 1 | Fault 1 | L3 |
| E | 0 | 1 | 0 | 0 | Trip Loop | L4 |
| F | 0 | 1 | 0 | 1 | Fault 1 | L3 |
| G | 0 | 1 | 1 | 0 | Trip Signal | L6 |
| H | 0 | 1 | 1 | 1 | Trip Signal | L6 |
| I | 1 | 0 | 0 | 0 | Fault 2 | L5 |
| J | 1 | 0 | 0 | 1 | Fault 3 | L7 |
| K | 1 | 0 | 1 | 0 | Fault 3 | L7 |
| L | 1 | 0 | 1 | 1 | Fault 3 | L7 |
| M | 1 | 1 | 0 | 0 | Fault 2 | L5 |
| N | 1 | 1 | 0 | 1 | Fault 3 | L7 |
| P | 1 | 1 | 1 | 0 | Trip Signal | L6 |
| Q | 1 | 1 | 1 | 1 | Trip Signal | L6 |

H is to be noted that certain combinations illustrated by the Truth Table would only occur if one or more of the components of the circuitry have failed. Combination H might indicate opening of a trip contact 123, 124 plus a failure of voltage supply V1 by opening of CFI-1. Combination Q might indicate failure of both voltage supplies and either or both of these conditions may be programed to indicate Trip Signal L6 and to energize Output Signal terminal 406. Display of lamp L3 indicates Fault 1, a failure of a component or voltage source in the off-normal loop, Fault 2 indicates a failure of a component or voltage source in the Trip Circuit loop and Fault 3 indicates a similar failure in both loops.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. In a redundancy circuit for improvement of the performance of trip control apparatus, said trip control apparatus having an individual off-normal anticipatory circuit and an individual trip circuit, where said off-normal circuit is activated by an off-normal sensor which opens the off-normal circuit and said trip circuit is activated by a trip sensor which opens the trip circuit and where said off-normal sensor and said trip sensor are each arranged to act in a proper and necessary sequence in response to behavior of a sensed variable, and where said electrical circuits are electrically connected to a logic module which causes a trip output action if and only if both of said electrical sensors are in unanimous agreement, an improvement which consists of adding an additional and alike sensor to each of said off-normal and trip circuits, and connecting the additional alike electrical sensors in series configuration so that opening of the off-normal circuit will be actuated by actuation of at least one off-normal sensor and opening of the trip circuit will be actuated by actuation of at least one trip sensor.

2. The combination as recited in claim 1, together with a solid state logic module connected to said redundancy circuit and fitted with display means to indicate the status of each of the off-normal and trip circuits.

* * * * *